US006870450B2

(12) United States Patent
Bauer et al.

(10) Patent No.: US 6,870,450 B2
(45) Date of Patent: Mar. 22, 2005

(54) ELECTROMAGNETIC SWITCHING DEVICE, IN PARTICULAR A CONTACTOR

(75) Inventors: Johann Bauer, Ebermannsdorf (DE); Stephan Faber, Kümmersbruck (DE); Bardo Koppmann, Kaltenbrunn (DE); Manuela Lüftl, Amberg (DE); Markus Meier, Rieden (DE)

(73) Assignee: Siemens Aktiengesellschaft, Munich (DE)

( * ) Notice: Subject to any disclaimer, the term of this patent is extended or adjusted under 35 U.S.C. 154(b) by 59 days.

(21) Appl. No.: 10/221,321

(22) PCT Filed: Mar. 12, 2001

(86) PCT No.: PCT/DE01/00926

§ 371 (c)(1),
(2), (4) Date: Sep. 11, 2002

(87) PCT Pub. No.: WO01/69625

PCT Pub. Date: Sep. 20, 2001

(65) Prior Publication Data

US 2003/0016105 A1 Jan. 23, 2003

(30) Foreign Application Priority Data

Mar. 17, 2002 (DE) ..... 100 13 314

(51) Int. Cl.[7] ..... H01H 67/02
(52) U.S. Cl. ..... 335/132; 335/202
(58) Field of Search ..... 335/6, 16, 147, 335/195, 132–133, 202, 14, 20; 200/293–308

(56) References Cited

U.S. PATENT DOCUMENTS

| | | | | | |
|---|---|---|---|---|---|
| 3,815,059 | A | * | 6/1974 | Spoelman | 335/16 |
| 4,644,308 | A | * | 2/1987 | Guery et al. | 335/128 |
| 5,040,089 | A | | 8/1991 | Sasaki | |
| 5,194,705 | A | | 3/1993 | Canault | |
| 5,258,732 | A | * | 11/1993 | Marquardt | 335/17 |
| 5,606,299 | A | * | 2/1997 | Innes et al. | 335/202 |
| 5,874,877 | A | * | 2/1999 | Kawashima et al. | 335/132 |

FOREIGN PATENT DOCUMENTS

| | | |
|---|---|---|
| EP | 0 122 291 A | 10/1984 |
| EP | 0 431 994 A | 6/1991 |
| FR | 2 607 318 A | 5/1988 |
| FR | 2 737 604 A | 2/1997 |
| WO | WO 95 12891 A | 5/1995 |

* cited by examiner

*Primary Examiner*—Lincoln Donovan
(74) *Attorney, Agent, or Firm*—Harness, Dickey & Pierce, P.L.C.

(57) ABSTRACT

The invention relates to an electromagnetic switching device, in particular a contactor, comprising a switching device housing (2) and a plug-in module which can be inserted into the latter and which contains a coil form (12) for a coil. A tripping element (60) is mounted on a housing section (40) of the plug-in module (4). Said element is designed to mechanically actuate the contact unit (30) of an electric switch (24) for producing an economy connection. The switch (24) is mounted on a support structure (printed-circuit board (22)) that is located in the plug-in module (4), with a supporting contour (70) of said switch adjoining a bearing contour (72) of the housing section (40).

14 Claims, 4 Drawing Sheets

ELECTROMAGNETIC SWITCHING DEVICE, IN PARTICULAR A CONTACTOR

Figure 1:
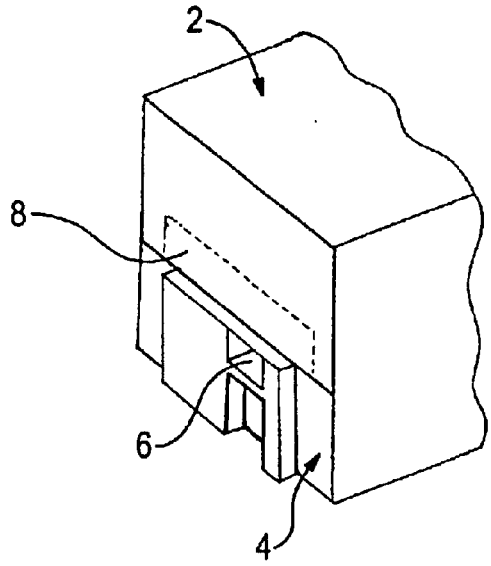

The invention relates to an electromagnetic switching device, in particular a contactor, having a withdrawable unit which can be inserted into a switching device enclosure and has a coil former for a coil, as is known, by way of example, from WO 95/12891.

A withdrawable unit such as this, which is referred to as a coil assembly, comprises at least one coil former which is fitted with one or more copper windings, and a connecting region via which the winding is supplied with an external voltage. The coil assembly forms the drive for the electromagnetic switching device.

One specific embodiment of such a drive is, for example, the so-called economy circuit drive. In this case, a relatively large amount of pull-in or connection power, which is required to switch the switching device, is reduced to a considerably lower holding power at a predetermined time. This has the advantage that it reduces the power consumption of the switching device in the connected state and, in a corresponding way, the power loss and, associated with this, the heat emission, are also reduced.

In order to provide such an economy circuit, it is known for a coil having two windings to be provided, one of which coils forms the pull-in winding while the other forms the holding winding. This pull-in winding is now interrupted by means of a mechanical itching element, so that current flows only through the holding winding. The mechanical switching element is in that case operated by a suitable tripping element which is moved by the moving unit of the switching device and operates the switching element at a predetermined time during the connection process. The difference distance which has to be traded by the moving unit (armature and contact slide) between the time at which the pull-in winding is disconnected and its final position (holding position) is overcome by the kinetic energy of e moving unit of the switching device. operates the switching element at a predetermined time during the connection process. The difference distance which has to be traveled by the moving unit (armature and contact slide) between the time at which the pull-in winding is disconnected and its final position (holding position) is overcome by the kinetic energy of the moving unit of the switching device.

In the case of an economy circuit, which is known from U.S. Pat. No. 5,040,089 for a DC relay, the overall power consumption is reduced in that, by the connection of one winding part of the drive coil or of an additional resistor, the tripping current which is passed via the tripping coil is reduced from a comparatively high connection current value to a comparatively low holding current value.

In order to ensure that the holding position can be reached with as little pull-in energy as possible, it is desirable for the switching point to occur as far as possible before the holding position. This requires the switching point to have an accurate position, in order to ensure that the holding position is reached.

The invention is now based on the object of specifying an electromagnetic switching device which, by virtue of its physical design, allows as narrow a tolerance band as possible for the switching point of an electrical switch which is installed in the switching device enclosure in order to provide a mechanical economy circuit.

According to the invention, said object is achieved by the features of patent claim 1. The electromagnetic switching device, in particular a contactor, according to the invention contains a switching device enclosure and a withdrawable unit which can be inserted into it and which has a coil former for a coil as well as a tripping element, which is mounted on an enclosure part of the withdrawable unit, for mechanical operation of the switching element of an electrical switch for an economy circuit, which switch is mounted on a supporting structure which is arranged in the withdrawable unit and is separate from the enclosure part, and which has a supporting contour which rests on a bearing contour of the enclosure part.

These measures result in the switch which is provided in order to produce the economy circuit being positioned in a fixed position with respect to a reference surface in the same enclosure part, in which the tripping element is also mounted, although the enclosure part and the supporting structure are two separate components, which are joined together only during manufacture of the withdrawable unit. As a result of these measures, the position of the switch relative to the tripping element is independent of the tolerances with which it is initially mounted on the supporting structure, preferably a printed circuit board, or with which the latter is arranged in the withdrawable unit relative to the enclosure part. The switching movement tolerances are thus reduced to a minimum.

In one preferred refinement of the invention, the force which is exerted on the switch during operation of the switching element is passed via the supporting contour to the bearing contour. This measure ensures that the switch remains in a fixed reference position with respect to the enclosure part, and hence with respect to the tripping element, even during operation.

The electrical switch is, in particular, mounted on a printed circuit board, which is arranged essentially parallel to the outer wall of the enclosure part, and at least a part of its enclosure which forms the supporting contour projects through this. This allows the withdrawable unit design to be particularly simple to manufacture.

The bearing contour is preferably arranged on the inner face of the outer wall, which has a reinforcing structure, especially in this area. This largely avoids deformation of the enclosure part during operation of the switching element.

In a further advantageous refinement of the invention, a trough is integrally formed on the enclosure part, on which the switch is arranged and is fixed in position by means of an encapsulation compound. This can be achieved particularly easily during manufacture. Furthermore, the encapsulation compound is at the same time used for protection of those electrical components which are arranged on the printed circuit board in addition to the switch.

Two side bearing arms are preferably arranged on the enclosure part, in order to support the tripping element. This allows the tripping element to be supported in a robust manner and accurately in position.

In a further preferred refinement of the invention, the coil former is provided on one of its end faces with at least one connecting arm, by means of which it is mounted on the enclosure part, in particular with the other end face having at least one latching hook, which latches in a corresponding recess on the enclosure part. This ensures that the coil former is held robustly on the enclosure part.

In particular, the recess is arranged in the bearing arm for the tripping element. This allows a particularly simple design configuration, since the bearing arms provide not only the function of supporting the tripping element but also the function of fixing the coil former.

Figure 2:
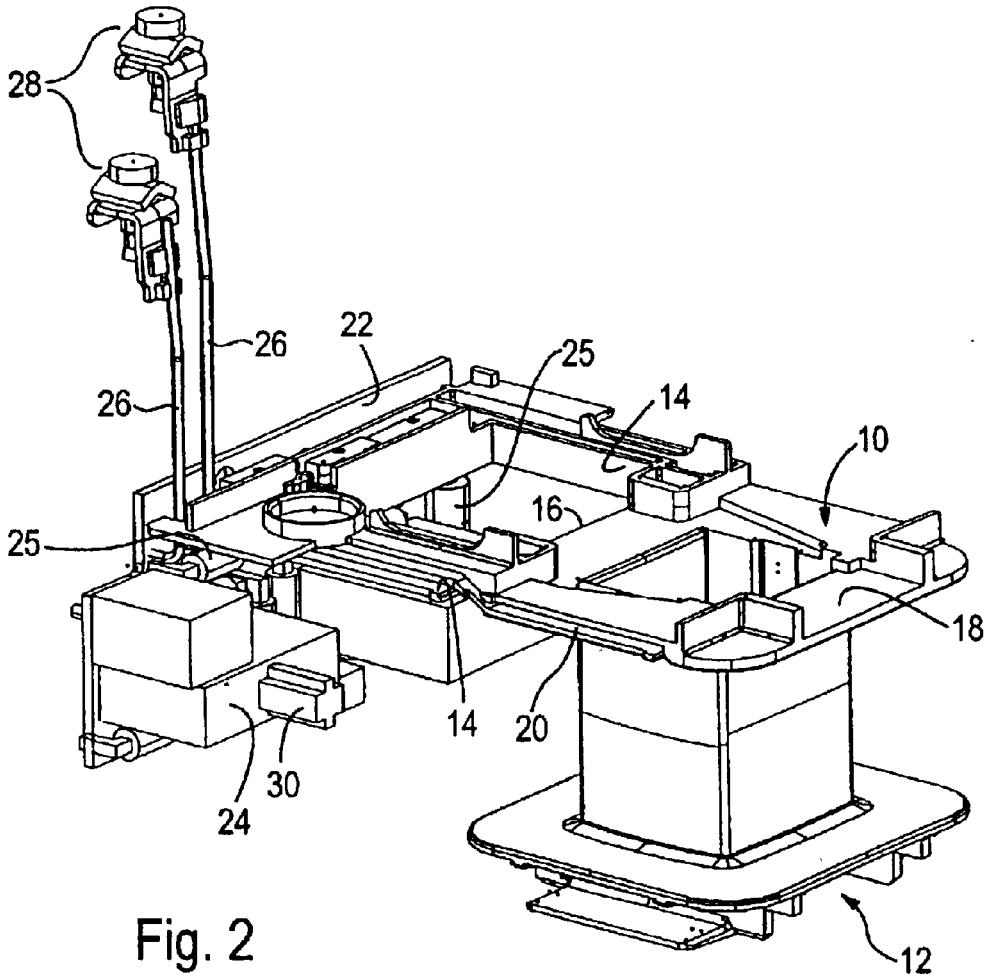
Figure 3:
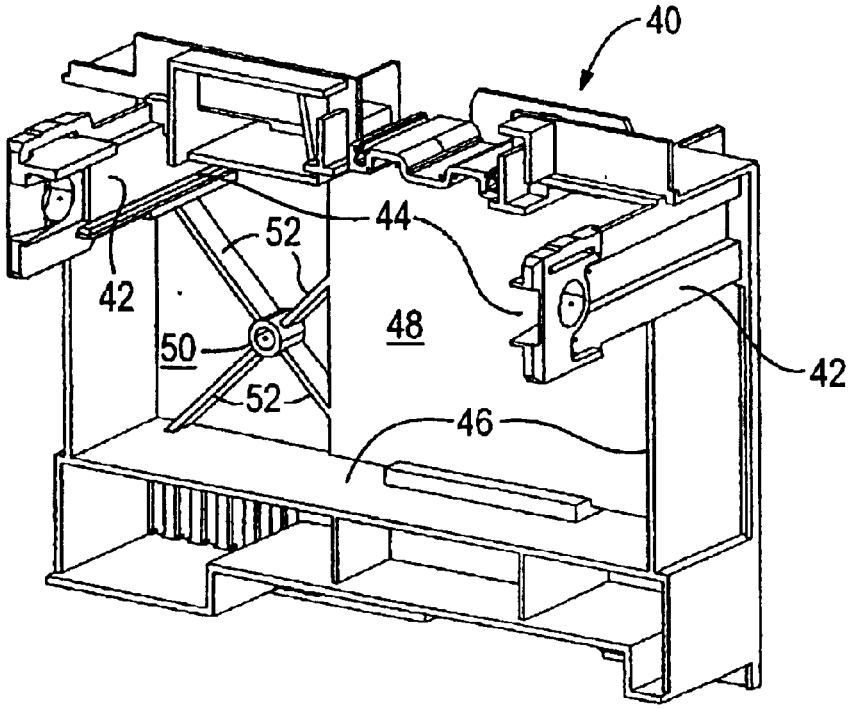
Figure 4:
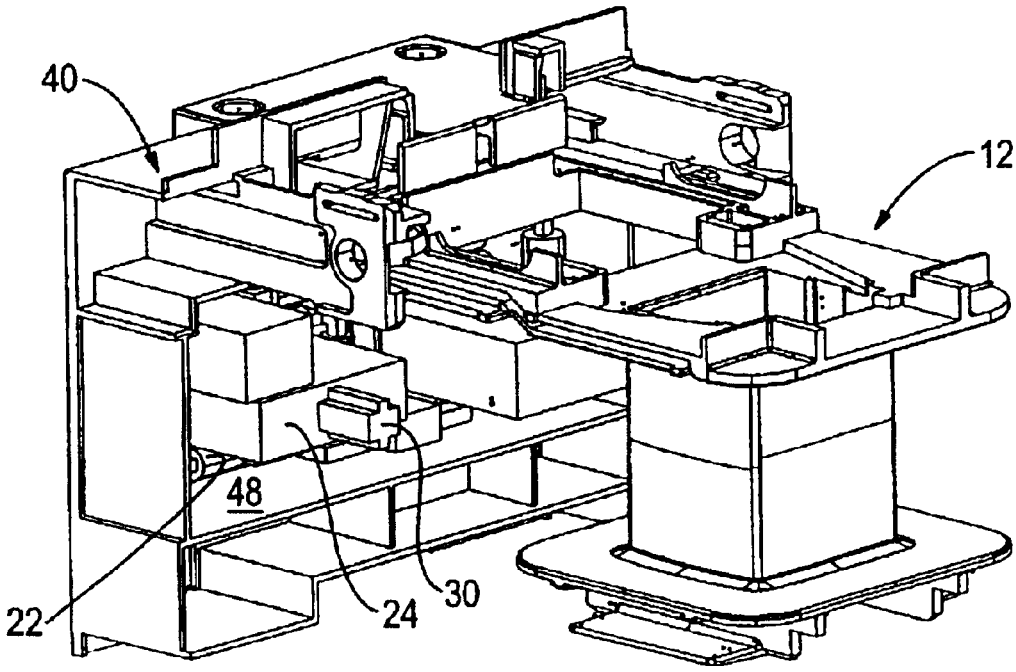
Figure 5:
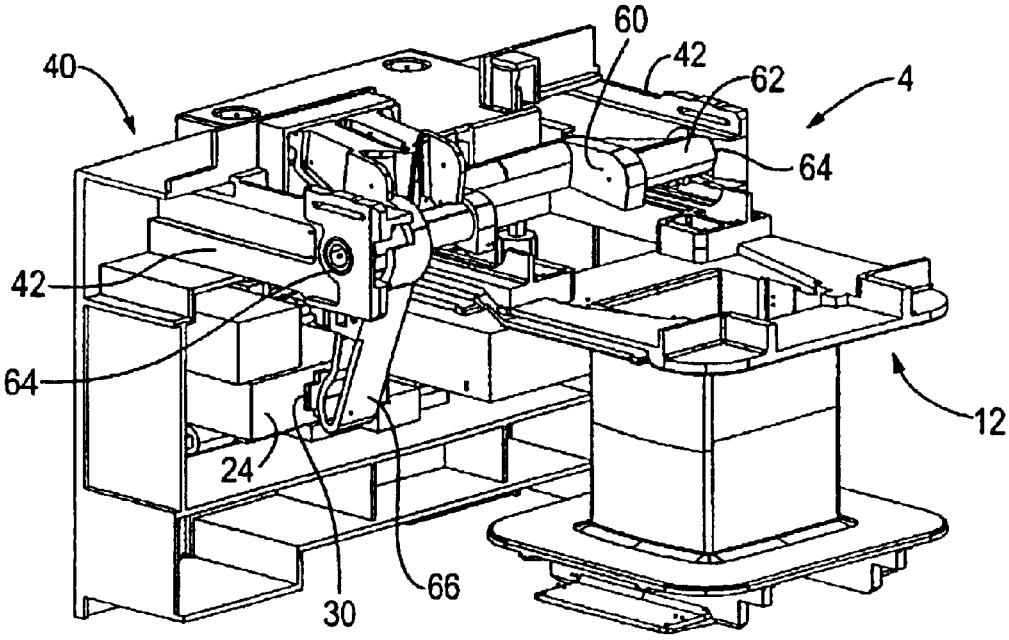
Figure 6:
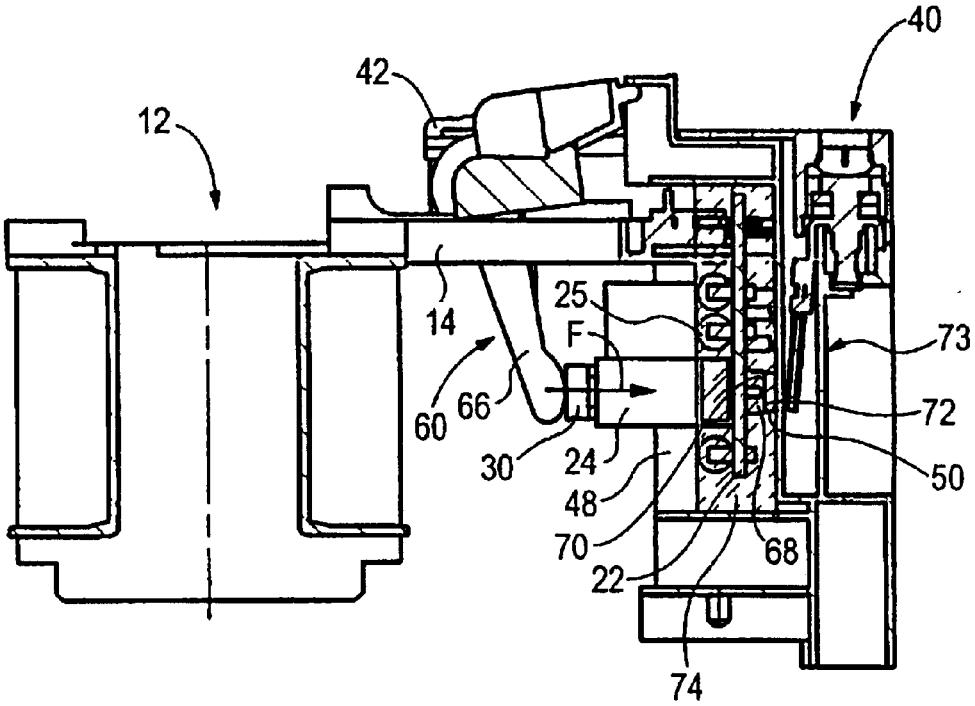
Figure 7:
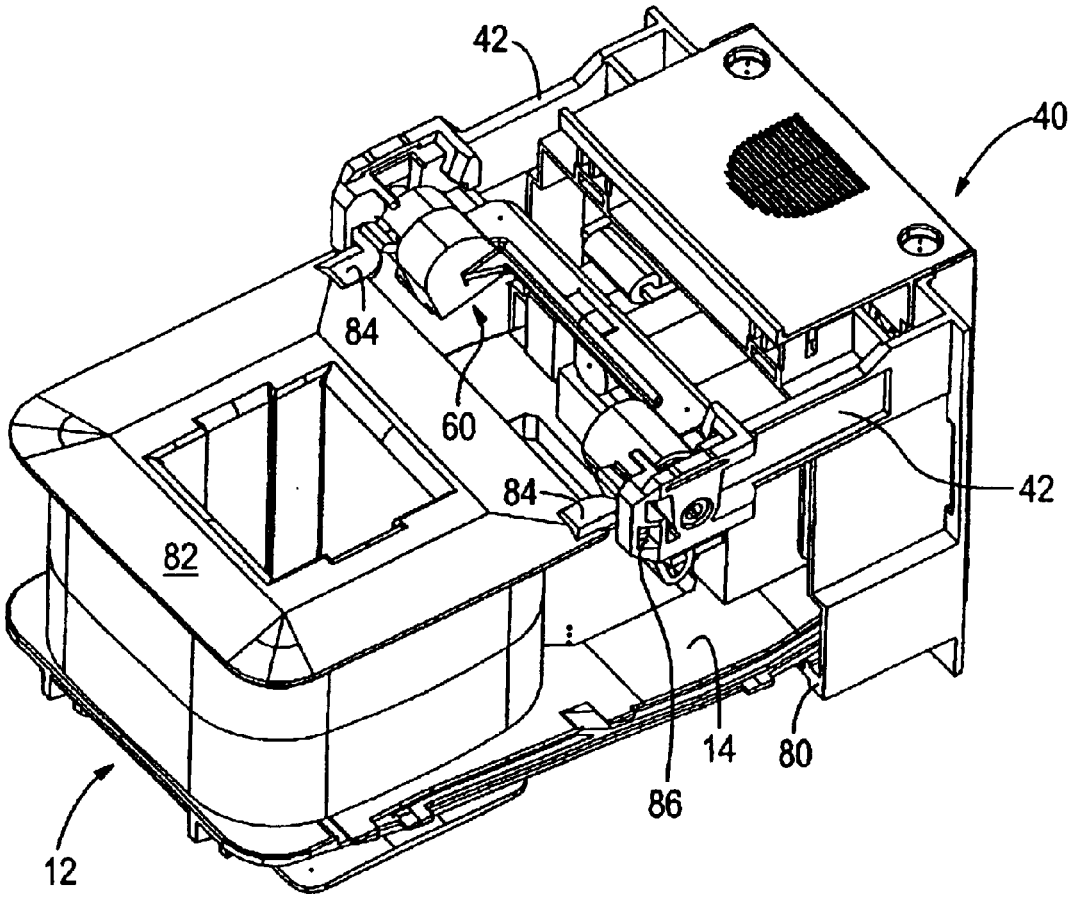

In order to explain the invention further, reference is made to the exemplary embodiments in the drawing, in which:

FIG. 1 shows an electromagnetic switching device according to the invention with a withdrawable unit inserted, shown in the form of an overall schematic view, FIG. 2 shows the coil former of the withdrawable unit with a printed circuit board positioned in it and holding the electrical switch, FIG. 3 shows the enclosure part for supporting the coil former, FIG. 4 shows the withdrawable unit with the coil former inserted into the enclosure part, FIG. 5 shows the withdrawable unit with the tripping element mounted in the enclosure part, likewise in a perspective view, FIG. 6 shows a cross section through the withdrawable unit, and FIG. 7 shows a further advantageous refinement of the invention, with a coil former mounted on both end faces on the enclosure part.

As shown in FIG. 1, an electromagnetic switching device, in the example a contactor, has a switching device enclosure 2 into which a withdrawable unit 4 (coil assembly) is inserted. The withdrawable unit 4 is provided on the enclosure cover side with a connecting area 6, in which the connecting contact elements for the coil winding of a coil for the withdrawable unit 4 are arranged. Dashed lines in the figure also indicate a connecting area 8 for the switching contacts of the electromagnetic switching device.

As shown in FIG. 2, one end face 10 of a coil former 12 is provided with two connecting arms 14, which form the limbs of a U, whose base is formed by one longitudinal edge 16 of the end frame 18 of the coil former 12. At least one of the connecting arms 14 is provided with a slot 20 at the side, in order to guide the ends of the coil winding, which is not shown in the figure.

A supporting structure, a printed circuit board 22 in the exemplary embodiment, is arranged on the free ends of the connecting arms 14 and acts not only as a support for an electrical switch 24 but also as a support for the other electronic components 25 which are required to provide an economy circuit. The electrical switch 24 is in this case initially mounted in a fixed position on the supporting structure.

The printed circuit board 22 is provided with contact pins, which cannot be seen in the figure, to which the ends of the coil winding are soldered. Connecting conductors 26 lead from the printed circuit board 22 to connecting contacts 28 for the control voltage, which is connected from the exterior to the switching device in order to operate it.

On its flat face facing away from the printed circuit board 22, the switch 24 has a switching element 30, whose axial movement mechanically operates the switch 24.

As shown in FIG. 3, an enclosure part 40, which is provided for holding the coil former 12 as well as the printed circuit board 22, is provided with two bearing arms 42 at the side, which are each provided on their inner face with guide elements 44 which are us to hold the coil former 12 (FIG. 2) which is to be pushed onto the enclosure part 40. The closure part 40 at the same time acts as a cover and is thus a component of the switching device enclosure 2 (FIG. 2) when the completely assembled detachable unit 4 (FIG. 1) is positioned in the switching device.

The enclosure part 40 is provided with side walls 46, which extend into the interior of the detachable unit 4 and together with the cover face, form a trough 48 for holding the printed circuit board 22 (FIG. 2). A supporting cylinder 50 is integrally formed at the bottom of the trough 48. Transverse struts 52, which are integrally formed on the bottom an at the same time form a reinforcing structure for the enclosure part 40 (which is a plastic injection-molded part) in the region of the supporting cylinder 50, open into the outer casing of the supporting cylinder 50. The reinforcing structure which is formed from the supporting cylinder 50 and the transverse struts 52 is located in a depression in the bottom of the trough 48.

FIG. 4 shows the withdrawable unit 4 with the coil former 12 inserted into the enclosure part 40. It can be seen from this figure that the populated printed circuit board 22 is mounted in the trough 48. The switch 24 is in this case located above the reinforcing structure, which can no longer be seen in the figure, with the supporting cylinder 50 (FIG. 3) being aligned with the longitudinal axis of the switching element 30, that is to say with the direction of the force which is exerted on it during operation.

FIG. 5 now shows the detachable unit 4 with the tripping element 60 installed. The tripping element 60 has a shaft 62 which is mounted in bearing eyes 64 of the bearing arms 42 such that it can pivot. A tripping lever 66 is fixed on the shaft 62, and operates the switching element 30 of the switch 24 when the shaft 62 is pivoted, with this pivoting movement being produced by the armature (which is not illustrated in the figure) of the switching device.

As shown in FIG. 6, the switch 24 has a bearing journal 68, by means of which it is passed through the printed circuit board 22. The bearing journal 68 is essentially in the form of a hollow cylinder and has a longitudinal slot, which separates this hollow cylinder into two half shells. This makes it easier to insert the bearing journal 68 into a corresponding hole in the printed circuit board 22. The switch 24 is latched to the printed circuit board 22 by means of a taper on the circumference of the bearing journal 68, thus making its installation easier.

The end surface of the bearing journal 68 forms a supporting contour 70, which is supported on that end surface of the supporting cylinder 50 which forms a resting contour 72, and of which only the end-face edge can be seen in the figure. The printed circuit board 22 is inserted with the preinstalled switch 24 and parallel to the outer wall 73 of the enclosure part 40 into the trough 48, until the supporting contour 70 of the switch 24 rests on the bearing contour 72 of the enclosure part 40. The switch 24 is then fixed in its position relative to the enclosure part 40, irrespective of any positioning tolerances on the printed circuit board 22. In this position, the trough 48 is filled with an encapsulation compound 74, so that the switch 24 is fixed in the nominal position relative to the enclosure part 40. The encapsulation compound 74 is at the same time used for protection of the further electronic components 25 which are arranged on the printed circuit board 22 in order to provide the economy circuit.

This measure results in the switch 24 being moved during assembly to a fixed and predetermined special position with respect to the enclosure part 40, and hence also with respect to the tripping element 66, which is arranged directly on the enclosure part 40 such that it can pivot, even though it is initially installed on a supporting structure which is separate from the enclosure part 40, this being the printed circuit board 22 in the exemplary embodiment. In other words: the tolerances with which the switch 24 is arranged on the supporting structure and with which the latter is installed in the enclosure part 40 have virtually no influence on the switching distance tolerances. These tolerances are thus reduced to a minimum and are independent of the installation position of the switch 24 on the printed circuit board 22, and of the installation position of the printed circuit board 22 in the trough 48.

The force F which is exerted on the switching element 30 by the tripping lever 66 in this case acts at right angles to the supporting contour 70 and is introduced into the resting contour 72, which is parallel thereto, so that the switch 24 remains in a stable position relative to the enclosure part 40, and hence with respect to the tripping element 60, even during operation.

In the alternative refinement of the invention as shown in FIG. 7, the connecting arms 14 of the coil former 12 are inserted on the enclosure part 40 into guides 80 which are opposite to the bearing arms 42, in order to support the tripping element 60 such that it can pivot. A latching hook 84 is in each case arranged in the corner regions facing the enclosure part 40 on the end face 82 of the coil former 12 opposite the connecting arms 14, which latching hook 84 engages in a recess 86 at the free end of the bearing arm 42, and produces a latching connection. This design refinement results in the coil former 12 being mounted robustly, with this being particularly advantageous in large switch types.

What is claimed is:

1. An electromagnetic switching device, comprising:

a switching device housing and a detachable unit, said detachable unit being insertable into the switching device housing;

an electric switch mounted in the detachable unit, wherein the detachable unit includes a supporting contour which rests on a bearing contour of said detachable unit, and wherein a force is exertable in an operating direction, upon a contact element of said electric switch; and a tripping element, said tripping element being mounted on a part of the detachable unit and being adapted to exert the force to mechanically operate the contact element, wherein said supporting contour and said bearing contour are aligned with the operating direction.

2. The electromagnetic switching device as claimed in claim 1, wherein the detachable unit includes a printed circuit board arranged substantially parallel to an outer wall of an enclosure part of the detachable unit, said electric switch being mounted on said printed circuit board on a surface facing away from said outer wall, and said supporting contour resting on said bearing contour and extending through a hole in the printed circuit board.

3. The electromagnetic switching device as claimed in claim 2, wherein a trough is integrally formed on the enclosure part, and wherein the switch is arranged in the trough and is fixed in position by way of an encapsulation compound.

4. The electromagnetic switching device as claimed in claim 2, wherein two side bearing arms are arranged on the enclosure part, in order to support the tripping element.

5. The electromagnetic switching device as claimed in claim 2, wherein the tripping element is mounted in the bearing arms, such that it can pivot, and is operatively connected via a pivoting lever to the switching element of the switch.

6. The electromagnetic switching device as claimed in claim 2, further comprising a coil former for a coil, including on one end face of the coil, at least one connecting arm, mounted on the enclosure part.

7. The electromagnetic switching device as claimed in claim 6, wherein on another end face of the coil includes at least one latching hook, which latches in a corresponding recess on the enclosure part.

8. The electromagnetic switching device as claimed in claim 7, wherein the recess is arranged on one of the bearing arms for the tripping element.

9. The electromagnetic switching device of claim 1, wherein the electromagnetic switching device is a contactor.

10. The electromagnetic switching device as claimed in claim 2, wherein a trough is integrally formed on the enclosure part, and wherein the electric switch is arranged in the trough and is fixed in position by way of an encapsulation compound.

11. The electromagnetic switching device as claimed in claim 9, wherein a trough is integrally formed on the enclosure part, and wherein the switch is arranged in the trough and is fixed in position by way of an encapsulation compound.

12. The electromagnetic switching device as claimed in claim 9, wherein two side bearing arms are arranged on the enclosure part, in order to support the tripping element.

13. The electromagnetic switch as claimed in claim 2, wherein the bearing contour is located on a supporting cylinder formed at an inner face of said outer wall, said supporting cylinder being aligned with said operating direction.

14. The electromagnetic switch as claimed in claim 13, wherein the enclosure part comprises at least one transverse strut formed integrally at the inner face of said outer wall, said strut opening into said supporting cylinder.

* * * * *